United States Patent [19]

Collipp

[11] Patent Number: 4,620,820

[45] Date of Patent: Nov. 4, 1986

[54] TENSION LEG PLATFORM ANCHORING METHOD AND APPARATUS

[75] Inventor: Bruce G. Collipp, Houston, Tex.

[73] Assignee: Shell Oil Company, Houston, Tex.

[21] Appl. No.: 716,319

[22] Filed: Mar. 27, 1985

[51] Int. Cl.[4] ..... E02D 5/54

[52] U.S. Cl. ..... 405/224; 114/265; 405/205

[58] Field of Search ..... 405/195, 204, 205, 206, 405/224, 225, 227; 114/264, 265

[56] References Cited

U.S. PATENT DOCUMENTS

| | | | |
|---|---|---|---|
| 3,572,044 | 3/1971 | Pogonowski | 405/227 X |
| 3,611,734 | 10/1971 | Mott | 405/206 |
| 3,943,725 | 3/1976 | Pennock | 405/195 |
| 4,320,993 | 3/1982 | Hunter | 405/224 |
| 4,386,874 | 6/1983 | Engelser et al. | 405/224 |
| 4,468,157 | 8/1984 | Horton | 405/224 |
| 4,540,314 | 9/1985 | Falkner, Jr. | 114/265 X |

*Primary Examiner*—Albert J. Makay
*Assistant Examiner*—Steven E. Warner

[57] ABSTRACT

A method and apparatus is presented for anchoring a tension leg platform to the ocean floor using an anchor having an upper and lower assembly. The anchor's upper assembly is operatively connected to the lower ends of the tethers forming the tension legs of the tension leg platform, and acts to space and align each tether in a vertical manner when the anchor's upper assembly is connected to the anchor's lower assembly, which has previously been secured to the ocean floor by anchor piles.

13 Claims, 4 Drawing Figures

TENSION LEG PLATFORM ANCHORING METHOD AND APPARATUS

BACKGROUND OF THE INVENTION

1. Field of the Invention

This invention relates to tensioned leg offshore platforms of the type used in oil and gas drilling and production and relates more particularly to an anchor apparatus located at the lower end of the tension legs of the tension leg platform that anchors the tension leg platform to the ocean floor.

2. Background of the Invention

As offshore exploration for oil and gas from subsea deposits has expanded into deeper and deeper waters, conventional rigid towers setting upon the ocean floor and extending upward to the surface have become more and more impractical.

One particular solution to this problem which has been proposed is the elimination of the rigid tower and the substitution therefor of a floating platform moored to the ocean floor by a plurality of vertical members which are placed under high tension loads due to excess buoyancy of the floating platform. Examples of such structures, which are generally referred to as tension leg platforms, are shown in U.S. Pat. No. 3,648,638 to Blenkarn and U.S. Pat. No. 3,919,957 to Ray, et al.

Typically, such a tension leg platform is designed to have a plurality of spaced clusters of vertical tension legs or tethering elements, each of said clusters including a plurality of tethers arranged in a predetermined pattern with all of the clusters additionally arranged in a predetermined pattern relative to each other, so that all of the tethers are arranged substantially vertically between the surface platform and anchors located upon the ocean floor. It is desirable that such tethers be vertically arranged, with no substantial skewing from a vertical line, because the tension variations created in the tethering elements by the forces exerted thereupon by the buoyant surface structure are greater if the tethers are non-vertical as compared to perfectly vertical.

This requires that the relative locations of all of the anchoring positions for the lower ends of the tethers be accurately located upon the ocean floor. The prior art shows several approaches to achieving this goal.

One approach is to construct a single unitary very large structure to be placed upon the ocean floor, which structure includes the anchoring points for each of the tethers and also generally includes connections for production risers or the like, which are to be connected to the floating platform. This solves the problem of providing accurate relative positioning of the tethers, but creates another problem in that the extremely large unitary anchor structure is difficult and expensive to manufacture, transport to the offshore drilling site, and install at a desired location upon the ocean floor. One such structure is shown in U.S. Pat. No. 3,611,734 to Mott.

Another somewhat different solution to this problem is to construct a unitary anchor structure, portions of which are hinged so as to allow the structure to partially collapse to thereby make it easier to transport, while still maintaining a predetermined spacing of the tether attachment points due to the non-variable relative positioning of those points once the structure is expanded to its final orientation. Such a structure is shown in U.S. Pat. No. 4,126,008 to Dixon.

The use of separate anchors for each cluster of tethering elements has been suggested in U.S. Pat. No. 3,919,957 to Ray, et al.; U.S. Pat. No. 3,982,492 to Steddum, and U.S. Pat. No. 3,996,755 to Kalinowski. In the Steddum and Ray, et al. patents the separate anchors are lowered to the ocean floor directly from the floating structure. The Kalinowski patent merely refers to the anchors as being preplaced without specifying any particular manner for locating and orienting the anchors.

An apparatus and method need to be disclosed that combines all of the more desirable features of the above references. The apparatus should, instead of the single massive unitary anchor structure, be relatively easy to transport and connect to the ocean floor. The apparatus should be simpler in design and fabrication than the hinged structure as disclosed in Dixon. And the time required in connecting separate anchor clusters to individual tethers should also be minimized, due to the possible exposure of the tension leg platform and its crew to oncoming storms while partially anchored to the ocean floor.

SUMMARY OF THE INVENTION

The present invention is directed to anchoring a tension leg platform of the type having a plurality of vertical tethers arranged in a predetermined pattern to an anchor, a portion of the anchor having been previously positioned upon the marine bottom of a body of water.

The anchor is divided into an upper and a lower assembly.

The lower assembly is placed upon the ocean floor and secured in position by means of anchor piles.

The anchor piles may be driven before the upper assembly of the anchor and the remaining portions of the tension leg platform arrive at the tethering location. In other words, the lower assembly may be installed several months before arrival and subsequent anchoring of the tension leg platform.

The upper assembly of the anchor is attached to the lower ends of the tension leg tethers as the tethers extend downwardly beneath the tension leg platform. The upper assembly thereby forms a relatively lightweight orientation template which insures that the tethers remain positioned vertically when the upper assembly is subsequently aligned and connected to the previously-installed anchor lower assembly, and that the tethers are correctly spaced at the seafloor.

Several advantages of the present structure become readily apparent. The use of a single large unitary base structure is eliminated and is replaced with a two piece assembly. The resultant decreased weight of the lower assembly now allows the lower assembly to be easily positioned upon the ocean floor.

The time-consuming connection of each individual tether to a base template has been simplified. Since the upper assembly may be positioned adjacent the bottom of the tension leg platform while the first sections of the tethers are initially connected to the upper assembly, intricate running, positioning and orienting of each tether down through the body of water to an anchored base plate is no longer required.

By use of the present invention, the intricate time consuming connection process of all of the tethers to a structure secured to the ocean floor has now been reduced to a one stab connection of the anchor's upper assembly to the anchor's lower assembly. In other words the entire connection process of a substantial number of tethers to an underwater anchor template has been reduced to the single connection of the upper assembly to the lower assembly.

Another advantage of this invention is the safer and easier methods of assembling and running the tension legs. The tension legs are usually made of relatively short pieces of pipe approximately 30 to 100 feet in length. Each of these is connected together by a threaded joint or welding. For tension leg platforms in 6000 feet of water a single leg could require joining 200 leg sections or if the design called for a total of 20 legs this would require the connection of 4000 joints. This process would require several days during which time motion of the Tension Leg Platforms due to wind, waves or currents could cause the legs to "tangle" or rub against each other. By use of the upper anchor assembly the bottom end of all of the tension legs would remain properly positioned avoiding any damage or entaglement.

Since each section of the two-piece anchor assembly of the present invention may be easily transported, fabricating the entire anchor structure in a hinged manner is no longer required.

It is therefore an object of the present invention to provide improved apparatus and methods for installing an underwater anchor.

Another object of the present invention is to provide an improved apparatus and method for accurately positioning and orienting the tension leg members of a tension leg platform to a seafloor anchor base.

Other and further objects, features and advantages of the present invention will be readily apparent to those skilled in the art upon a reading of the following disclosure when taken in conjunction with the accompanying drawings.

DETAILED DESCRIPTION OF THE DRAWINGS

Figure 1:
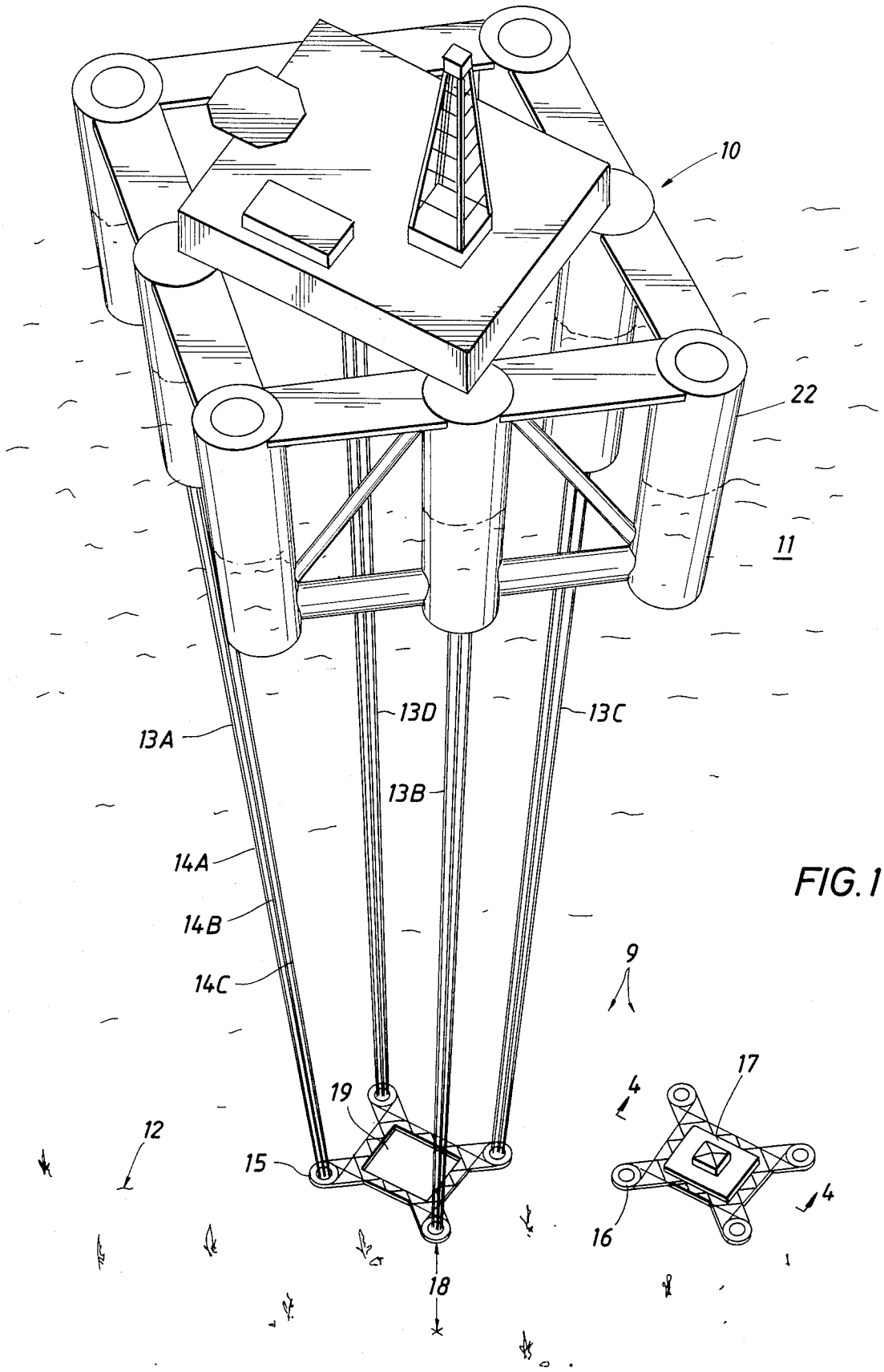
FIG. 1 is an isometric view of a tension leg platform and tether base suspended downwardly therefrom prior to connection of the tether base to a previously-installed anchor secured to the ocean floor.

Referring to FIG. 1, a tension leg platform anchor apparatus 9 is shown located beneath a tension leg platform 10 which is floating upon a body of water 11 having a marine bottom 12. Tension legs 13A through D extend downwardly from the tension leg platform 10. Tension leg 13A consists of flexible tethers 14A through C, each tether which may consist of tubular steel pipe, well known to the art. The tethers 14 forming each tension leg 13 are shown operatively connected to a tether base 15 at their lower ends, the tether base 15 forming the upper assembly of the tension leg platform anchor apparatus 9.

Tether base 15 is formed so as to operatively engage and subsequently connect with anchor means 16 which forms the lower assembly of the tension leg platform anchor apparatus 9. Cooperating portions of alignment means may be carried by the tether base 15 and anchor means 16 to align and position the base 15 with the anchor means 16. In a preferred embodiment, an alignment body means 17 protrudes upwardly from a central portion of anchor means 16 an alignment body clearance distance 18. The alignment body means 17 is formed so as to pass upwardly through an alignment body means opening 19 formed through a central portion of the tether base 15.

In general, it is recognized that the tether base 15 may be provided with a first portion of an alignment means. The second portion of the alignment means may correspondingly be formed or carried by the anchor means 16, and cooperate with the first portion so as to properly align and position the tether base 15 with respect to the anchor means 16.

As mentioned earlier, the alignment body means opening 19 forms the first portion of the alignment means, and the alignment body means 17 forms a second portion of the alignment means. It is understood that many other variations in alignment devices may be used to accomplish the same mechanical results of alignment of the tether base 15 with the anchor means 16. Other methods of guidance and alignment such as stabbing guides, vertical wire rope guidelines and other methods well known to the art may be used.

Figure 2:
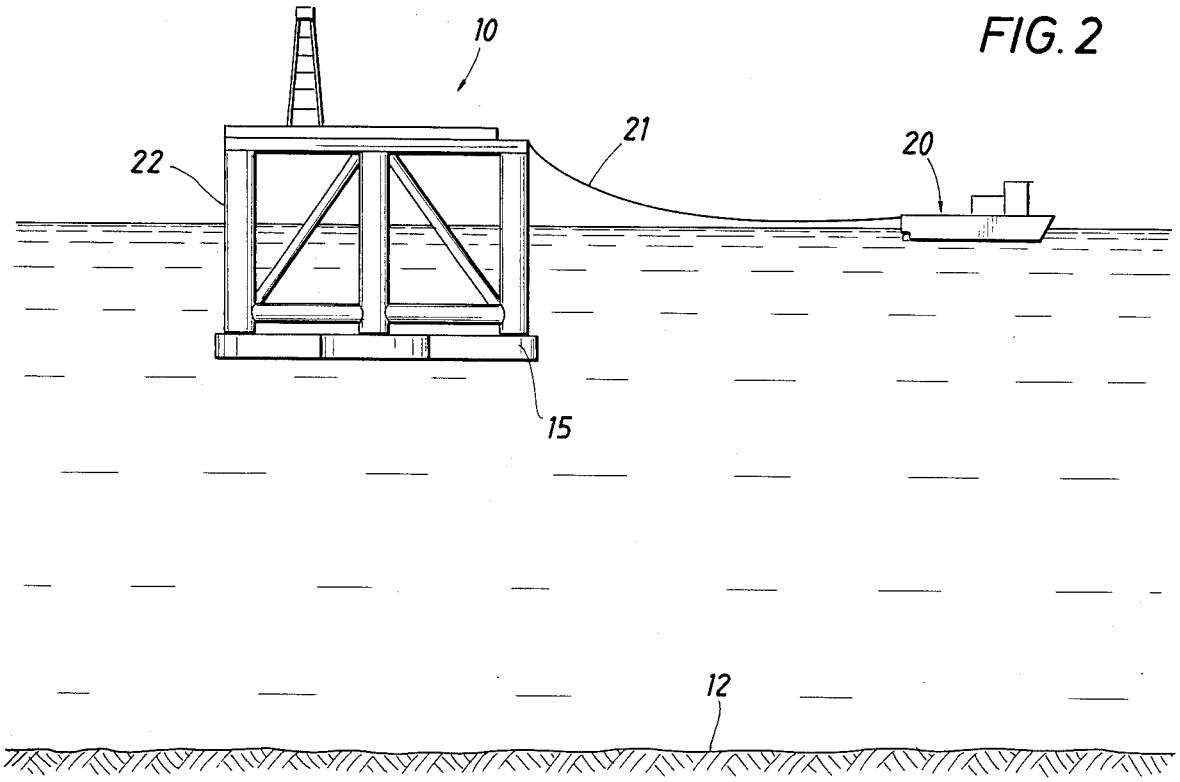
FIG. 2 is a schematic representation showing the tension leg platform being towed, with the tether base located adjacent to the bottom of the tension leg platform.

Referring now to FIG. 2 a tension leg platform 10 is shown towed by vessel 20 by means of tow line 21. Tether base 15 is shown positioned adjacent the lower portion of the tension leg platform 10. The buoyant hull 22 of the tension leg platform 10 has sufficient buoyancy to support tether base 15, or alternatively buoyancy means may be incorporated into tether base 15, as is well known to the art.

Figure 3:
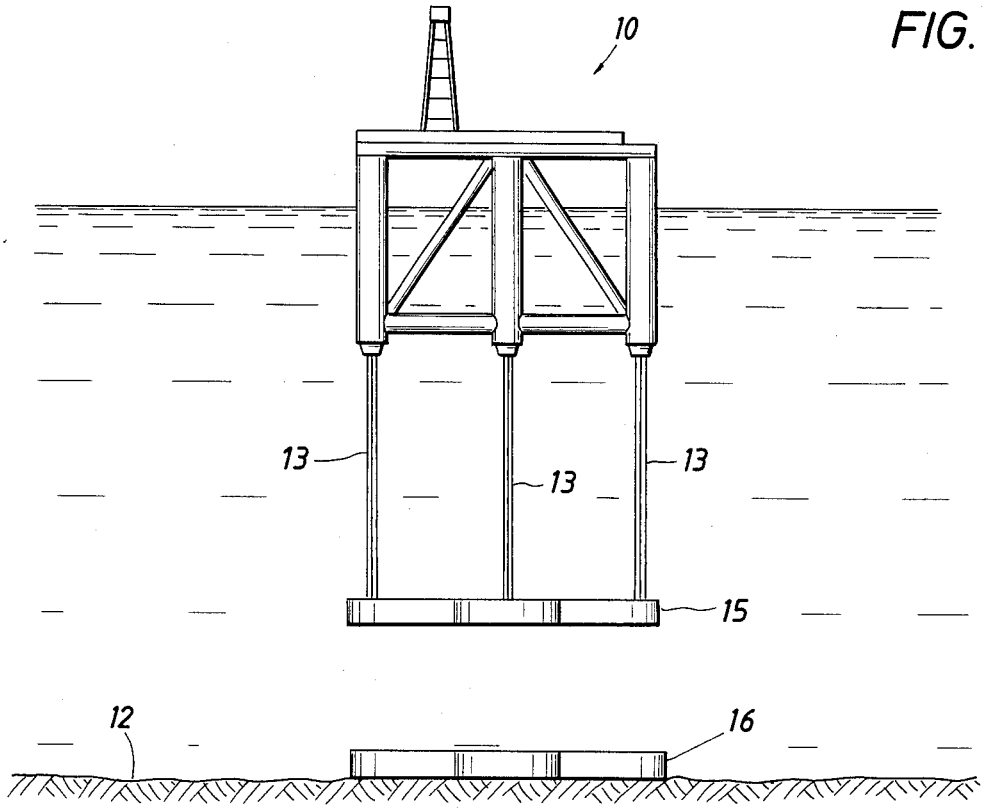
FIG. 3 is a schematic representation showing the tether base lowered below the tension leg platform, the tether base being connected to the lower ends of tension legs.

Referring now to FIG. 3, the tether base 15 is shown lowered a distance below the tension leg platform 10 by the lengthening of tension legs 13, the tether base 15 shown positioned above anchor means 16. The tether base 15 effectively maintains the tethers 14 in proper spaced relationship relative to each other as the tethers 14 are joined and then lowered downward from the tension leg platform 10, and prevents each tether 14 from contacting adjacent tethers 14 during the installation and/or final tensioning of the tethers 14.

Figure 4:
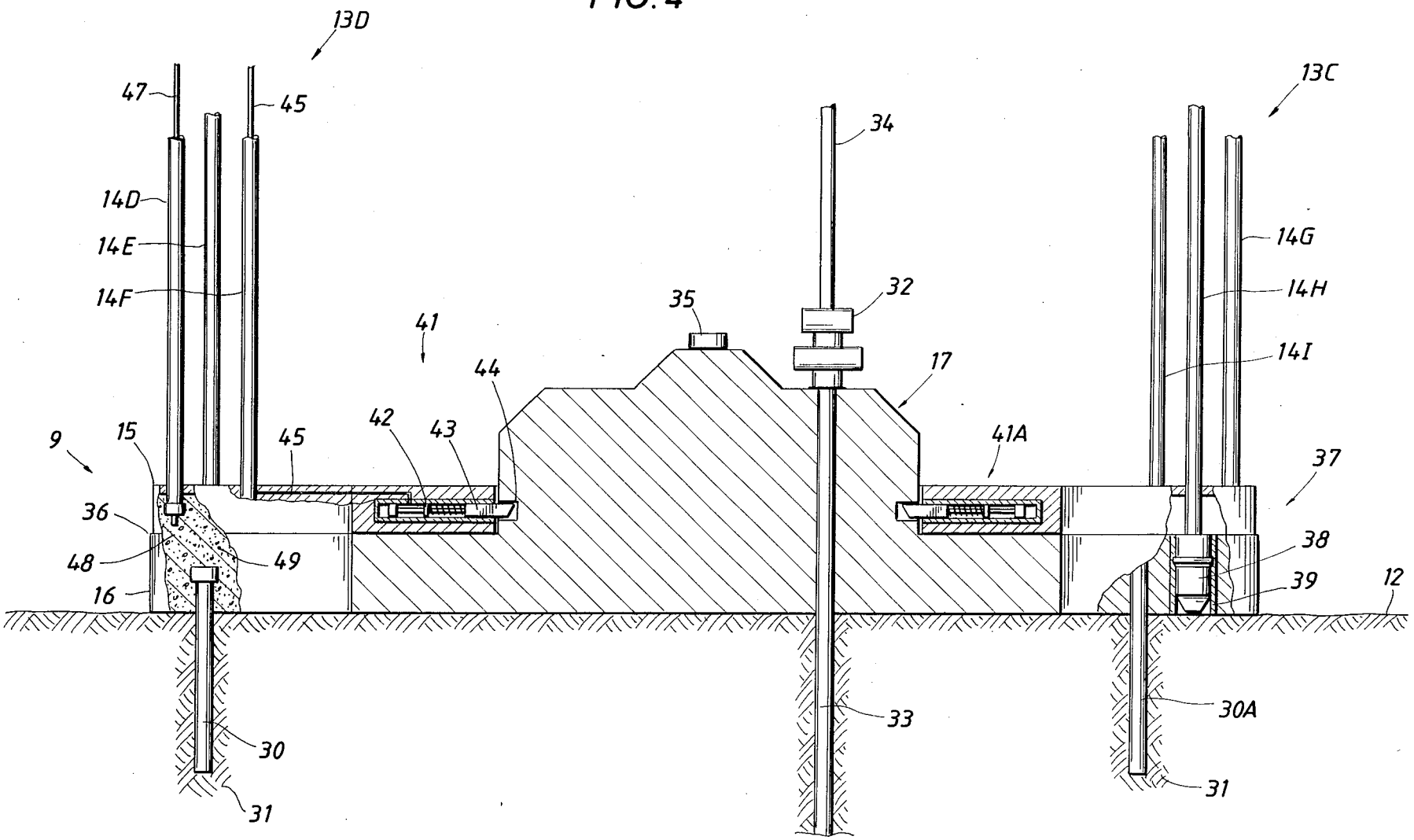
FIG. 4 is a schematic representation showing the tether base which forms the anchor's upper assembly connected by various means to the anchor's lower assembly.

Referring now to FIG. 4, anchor means 16 which form the anchor's lower assembly are shown secured to the marine bottom 12 by anchor piles 30, 30A which have been driven downwardly into the substratum 31. A wellhead 32 is shown carried by the upper portion of the alignment body means 17, the wellhead 32 placing the well conductor 34 in fluid communication with the flow line 34. It is recognized that wells may also be drilled and completed down through the individual tethers 14. A sonar transmitter 35 well known to the art and located atop the alignment body means 17, assists in the proper positioning of the tether base 15 upon the anchor means 16. Shoulder means 36 prevent further downward movement of the tether base 15 past the anchor means 16, after the tether base 15 has contacted the anchor means 16. Shoulder means 36 may form a part of the second portion of the alignment means carried or formed by the anchor means 16, and can be seen to have an upwardly facing substantially horizontal surface.

Tether connection means 37 consisting of an expandable member 38 positioned within receptacle 39 are shown as one possible means of connection of the tether base 15 to the anchor base 16. Alternatively, side connection means 41, 41A consisting in a preferred embodiment of hydraulic piston and cylinder 42 carried by the tether base 15 may drive latch bar 43 into engagement with a recess 44 formed in the side of the alignment body means 17 of the anchor means 16. A hydraulic line 45 may supply hydraulic fluid to the hydraulic piston and cylinder 42 to operate the side connection means 41, 41A by means well known to the art.

A removable cement line 47 may supply cement 48 downwardly from the tension leg platform 10 to a cement chamber 49 formed common to both the anchor means 16 and the tether base 15 in order to cement and thereby connect the anchor means 16 to the tether base 15.

In general, the connection means used to connect the anchor means 16 to the tether base may form a first portion formed or carried by the tether base 15, and a second portion which cooperates with the first portion and is carried or formed by the anchor means 16. Connection of the first portion to the second portion connects the tether base 15 to the anchor means 16. For example, the hydraulic piston and cylinder 42 mentioned earlier forms the first portion of the connection means, and the recess 44 forms the second portion of the connection means. It is understood that many other connection device variations may be used to accomplish the same mechanical results of connecting the tether base 15 to the anchor means 16.

Referring more specifically to FIGS. 1 and 4 the tension leg platform anchor apparatus 9 can be seen to comprise anchor means 16 which are secured to the marine bottom 12 by anchor piles 30, the anchor means 16 having alignment body means 17 protruding upwardly from a central portion of the anchor means 16. It is recognized that many orientation and alignment systems may be used to properly mate the tether base 15 to the anchor means 16. Shoulder means 36 are shown formed about the outer periphery of the anchor means 16 whereupon the shoulder means extend outwardly from the alignment body means 17 in a substantially horizontal manner.

It is recognized that whereas in FIG. 4 several methods and apparatus are presented showing means for connecting the tether base 15 to the anchor means 16, such as by hardening cement between the anchor means 16 and the tether base 15, or by actuation of side connection means 41, 41A, or by actuation of expendable member 38 within receptacle 39, many other methods and apparatus may be used to effectively connect the tether base 15 to the anchor means 16.

In operation, the tension leg platform 10 may be anchored to a selected marine bottom 12 location by first lowering the anchoring means 16 downwardly through the body of water 11 to the marine bottom 12. The anchor means 16 is then secured to the marine bottom 12 with anchor piles 30 in a method well known to the art. Prior to, during, or subsequent to the installation of the anchor means 16 to the marine bottom 12, the tether base 15 may be operatively connected to the lower ends of the flexible tethers 14, preferably as shown in FIG. 2 as the tether base 15 is located adjacent to the bottom of the tension leg platform structure 10. In this manner the tethers 14 need not be run any distance to the marine bottom 12 prior to their final connection to the tether base 15, substantially simplifying the individual tether 14 connections for the entire tether 14 array forming all of the tension legs 13.

Referring now to FIG. 3, once the tether base 15 is connected to the tethers 14 it may be lowered downwardly through the body of water 11 by increasing the length of the tethers 14 during the construction thereof, preferably simultaneously with one another by means well known to the art. As the tether base 15 is lowered downwardly through and substantially adjacent the anchor means 16, the tether base 15 may be centrally positioned at least at a selected clearance distance 18 above the orienting or alignment body means 17 of the anchor means 16. The alignment body means opening 19 of the tether base 15 may then be aligned with the alignment body means 17 of the anchor means 16 by selectively contacting portions of the alignment body means 17 to the sides of the tether base 15 formed around the periphery of the alignment body means opening 19 defined upwardly through the tether base 15, until the tether base 15 is properly aligned with cooperating elements of the anchor means 16. As the tether base 15 is being aligned with the anchor means 16, the tether base 15 may be continued to be lowered downwardly through the body of water 11 until the lower surface of the tether base 15 contacts with the shoulder means 36 of the anchor means 16, the contact preventing further downward movement of the tether base 15 relative to the anchor means 16.

At this point in time the tether base 15 may be connected to the anchor means 16. As mentioned previously several methods, or combination of methods, may be used to connect the tether base 15 to the anchor means 16. For example, the tether base 15 may be provided with side connection means 41, 41A mentioned earlier which have at least one latch bar 43 which may be inserted into at least one cooperating recess 44 formed in the side of the alignment body means 17 of the anchor means 16.

Alternatively, the anchor means 16 may be provided with a portion of a cement chamber 49 that is defined within the anchor means 16. Additionally, the tether base 15 may be provided with another portion of the same cement chamber 49 so that a common cement chamber 49 is formed between the tether base 15 and the anchor means 16 when both tether base 15 and anchor means 16 are placed in their final connection position adjacent each other. The tether base 15 may be provided with a downwardly extending fluid conduit such as a cement line 47 shown in FIG. 4 which may be placed in fluid communication with a pressurized source (not shown) of cement 48 carried by the tension leg platform 10, whereupon the conduit 47 terminates in at least one portion of the cement chamber 49. Once the tether base 15 is properly aligned atop the anchor means 16 shoulder means 36 a sufficient quantity of cement 48 may be then pumped down through the cement line 47 into the cement chamber 49 to fill both portions of the cement chamber 49. Allowing the cement 48 to harden prior to tensioning the tension legs 13 of the tension leg platform 10 will effectively connect the tension leg platform 10 through the tether base 15 to the anchor means 16.

Alternatively, the tether base 15 may be provided with a plurality of expandable members 38 mentioned earlier which may be connected to the lower ends of a corresponding number of tethers 14, where the expandable members 38 may be expanded within receptacles 39 defined vertically downward through a portion of the anchor means 16 such that the expandable members 38 when expanded will have an outer diameter greater than the inner diameter of an upper portion of said receptacles 39 in order to prevent the expanded members 38 from moving upwardly out of said receptacles 39.

It is well recognized that the side connection means 41, 41A, the cement 48, and the expandable member 38 forming a portion of the tether connection means 37 may all be used alternatively or in combination with one another in order to form a substantial anchoring system in order to operatively connect the tether base 15 to the anchor means 16.

Many other variations and modifications may be made in the apparatus and techniques hereinbefore described, both by those having experience in this technology, without departing from the concept of the present invention. Accordingly, it should be clearly understood the apparatus and methods depicted in the accompanying drawings and referred to in the foregoing description are illustrative only and are not intended as limitations on the scope of the invention.

I claim as my invention:

1. A tension leg platform anchor apparatus adapted to be positioned on a marine bottom of a body of water, to secure a tension leg platform to said marine bottom, said tension leg platform having a buoyant hull adapted to float in said body of water and a plurality of tension legs depending vertically downward from said buoyant hull a common distance, each tension leg formed from a plurality of flexible tethers, said tension leg platform anchor apparatus comprising:

anchor means securable to said marine bottom by anchor piles, a tether base operatively connectable when positioned adjacent said tension leg platform to the lower ends of said flexible tethers forming said tension legs, said tether base operatively connectable to said anchor means, and connection means comprising a first and a second portion, said first portion carriable by said tether base, said second portion carriable by said anchor means, to connect said tether base to said anchor means.

2. A tension leg platform anchor apparatus for use in anchoring a tension leg platform to a marine bottom of a body of water, said tension leg platform having a buoyant hull floating in said body of water and a plurality of tension legs depending vertically downward from said buoyant hull a common distance, each tension leg formed from a plurality of flexible tethers, said tension leg platform anchor apparatus comprising:

anchor means secured to said marine bottom by anchor piles, a tether base operatively connected when positioned adjacent said tension leg platform to the lower ends of said flexible tethers forming said tension legs, said tether base operatively connected to said anchor means, and connection means comprising a first and a second portion, said first portion carried by said tether base, said second portion carried by said anchor means, to connect said tether base to said anchor means, thereby securing said tension leg platform to said marine bottom.

3. The apparatus of claim 2 wherein said tension leg platform anchor apparatus further includes alignment means comprising a first and a second portion, said first portion carried by said tether base and said second portion carried by said anchor means, to align and position said tether base relative to said anchor means.

4. A tension leg platform anchor apparatus for use in anchoring a tension leg platform to a marine bottom of a body of water, said tension leg platform having a buoyant hull floating in said body of water and a plurality of tension legs depending vertically downward from said buoyant hull a common distance, each tension leg formed from a plurality of flexible tethers, said tension leg platform anchor apparatus comprising:

anchor means secured to said marine bottom by anchor piles, said anchor means having alignment body means protruding upwardly from a central portion of said anchor means, said alignment body means having at least one recess formed in a side of said alignment body means, said anchor means having shoulder means formed about the outer periphery of said anchor means, said shoulder means extending outwardly from said alignment body means in a substantially horizontal manner, said anchor means having a portion of a cement chamber defined within said anchor means, and a tether base operatively connected to the lower ends of said flexible tethers forming said tension legs, said tether base having an alignment body means opening defined upwardly through a central portion of said tether base to allow said tether base to be aligned with said alignment body means of said anchor means, prior to contact of said tether base with said shoulder means of said anchor base, said tether base having connection means including side connection means having at least one latch bar inserted into at least one cooperating recess formed in the side of said alignment body means of said anchor means to initially connect said tether base to said anchor means, said tether base having a portion of said cement chamber defined therein, and at least one upwardly extending fluid conduit placed in fluid communication with a pressurized source of cement carried by said tension leg platform, said conduit terminating in at least one portion of said cement chamber, said conduit having discharged cement into both portions of said cement chamber, said cement, when hardened, further connecting said tether base to said anchor means.

5. A tension leg platform anchor apparatus for use in anchoring a tension leg platform to a marine bottom of a body of water, said tension leg platform having a buoyant hull floating in said body of water and a plurality of tension legs depending vertically downward from said buoyant hull a common distance, each tension leg formed from a plurality of flexible tethers, said tension leg platform anchor apparatus comprising:

anchor means secured to said marine bottom by anchor piles, a tether base operatively connected to the lower ends of said flexible tethers forming said tension legs, said tether base operatively connected to said anchor means, connection means comprising a first and a second portion, said first portion carried by said tether base, said second portion carried by said anchor means, to connect said tether base to said anchor means, thereby securing said tension leg platform to said marine bottom, and alignment means comprising a first and a second portion, said first portion carried by said tether base and said second portion carried by said anchor means, to align and position said tether base relative to said anchor means, said first portion of said alignment means including an alignment body means opening defined upwardly through a central portion of said tether base, said second portion of said alignment means including an alignment body means which protrudes upwardly from a central portion of said anchor means, said alignment body means formed to pass upwardly through said alignment body means opening, said second portion of said alignment means further including shoulder means located about the outer periphery of said anchor means having an upwardly facing substantially horizontal surface, to prevent further downward movement of said tether base after said tether base contacts said shoulder means.

6. A tension leg platform anchor apparatus for use in anchoring a tension leg platform to a marine bottom of a body of water, said tension leg platform having a buoyant hull floating in said body of water and a plurality of tension legs depending vertically downward from said buoyant hull a common distance, each tension leg formed from a plurality of flexible tethers, said tension leg platform anchor apparatus comprising:

anchor means secured to said marine bottom by anchor piles, a tether base operatively connected to the lower ends of said flexible tethers forming said tension legs, said tether base operatively connected to said anchor means, and connection means comprising a first and a second portion, said first portion carried by said tether base, said second portion carried by said anchor means, said first portion of said connection means forming at least one upwardly extending fluid conduit placeable in fluid communication with a pressurized source of cement carried by said tension leg platform, the lower end of said conduit terminating within a cement chamber common to said tether base and said anchor means, said cement chamber fillable with cement supplied from said fluid conduit, said cement, when hardened, connecting said tether base to said anchor means, thereby securing said tension leg platform to said marine bottom.

7. A method of simultaneously anchoring all of the legs of a tension leg platform to a marine bottom of a body of water by use of a tension leg platform anchor apparatus, said tension leg platform having a buoyant hull floating in said body of water and a plurality of tension legs depending vertically downward from said buoyant hull a common distance, each tension leg formed from a plurality of flexible tethers, said tension leg platform anchor apparatus having:

anchor means securable to said marine bottom by anchor piles, a tether base operatively connectable to the lower ends of said flexible tethers forming said tension legs, said tether base operatively connectable to said anchor means, and connection means comprising a first and a second portion, said first portion carriable by said tether base, said second portion carriable by said anchor means, to connect said tether base to said anchor means, said method comprising:

lowering said anchor means downwardly through said body of water to said marine bottom, securing said anchor means to said marine bottom with anchor piles, operatively connecting said tether base to said lower ends of said flexible tethers, lowering said tether base downwardly through said body of water by increasing the length of said tethers, positioning said tether base at least a selected clearance distance above an alignment body means of said anchor means, aligning an alignment body means opening defined upwardly through said tether base with said alignment body means of said anchor means, by selectively contacting portions of said alignment body means of said anchor means to the sides of said tether base formed around the periphery of said alignment body means opening, until said tether base is aligned with said anchor means, contacting said tether base to said anchor means, and connecting said first portion of said connection means of said tether base to said second portion of said connection means of said anchor means thereby connecting said tether base to said anchor means.

8. A method of simultaneously anchoring all of the legs of a tension leg platform to a marine bottom of a body of water by use of a tension leg platform anchor apparatus, said tension leg platform having a buoyant hull floating in said body of water and a plurality of tension legs depending vertically downward from said buoyant hull a common distance, each tension leg formed from a plurality of flexible tethers, said tension leg platform anchor apparatus having:

anchor means securable to said marine bottom by anchor piles, a tether base operatively connectable to the lower ends of said flexible tethers forming said tension legs, said tether base operatively connectable to said anchor means, and connection means comprising a first and a second portion, said first portion carriable by said tether base, said second portion carriable by said anchor means, to connect said tether base to said anchor means, said method comprising:

lowering said anchor means downwardly through said body of water to said marine bottom, securing said anchor means to said marine bottom with anchor piles, operatively connecting said tether base to said lower ends of said flexible tethers, lowering said tether base downwardly through said body of water by increasing the length of said tethers into contact with said anchor means, providing said anchor means with a first portion of a cement chamber defined within said anchor means, said first portion of said cement chamber forming said second portion of said connection means of said anchor means, providing said tether base with a second portion of said cement chamber defined therein and at least one upwardly extending fluid conduit placed in fluid communication with a pressurized source of cement carried by said tension leg platform, said conduit terminating in at least one portion of said cement chamber, said second portion of said cement chamber and said fluid conduit forming said first portion of said connection means of said tether base, pumping a sufficient quantity of cement down through said conduit into said cement chamber to fill both portions of said cement chamber, and allowing said cement to harden prior to tensioning said tension legs of said tension leg platform, thereby connecting said tether base to said anchor means, by connecting said first portion of said connection means of said tether base to said second portion of said connection means of said anchor means.

9. A method of simultaneously anchoring all of the legs of a tension leg platform to a marine bottom of a body of water by use of a tension leg platform anchor apparatus, said tension leg platform having a buoyant hull floating in said body of water and a plurality of tension legs depending downward from said buoyant hull, each tension leg formed from a plurality of flexible tethers, said tension leg platform anchor apparatus having:

anchor means securable to said marine bottom by anchor piles, a tether base operatively connectable to the lower ends of said flexible tethers forming said tension legs, said tether base operatively connectable to said anchor means, and connection means comprising a first and a second portion, said first portion carriable by said tether base, said second portion carriable by said anchor means, to connect said tether base to said anchor means, said method comprising:

securing said anchor means to said marine bottom with anchor piles, and connecting said first portion of said connection means of said tether base to said second portion of said connection means of said anchor means, said tether base previously having been connected to said lower ends of said flexible tethers, thereby connecting said tether base to said anchor means.

10. The method of claim 9 including, prior to the step of securing said anchor means to said marine bottom with anchor piles, the following steps of;

lowering said anchor means downwardly through said body of water to said marine bottom, and contacting said anchor means to said marine bottom.

11. The method of claim 9 including, subsequent to the step of securing said anchor means to said marine bottom with anchor piles, the following steps of;

operatively connecting said tether base to said lower ends of said flexible tethers, and lowering said tether base downwardly through said body of water by increasing the length of said tethers into contact with said anchor means.

12. The method of claim 9 including, prior to securing said anchor means to said marine bottom with anchor piles, the following step of;

operatively connecting said tether base to at least a portion of the lower ends of said flexible tethers.

13. The method of claim 9 including, prior to securing said anchor means to said marine bottom with anchor piles, the following steps of;

operatively connecting said tether base to said lower ends of said flexible tethers, and lowering said tether base downwardly through said body of water by increasing the length of said tethers.

* * * * *